US006221239B1

(12) United States Patent
Morel et al.

(10) Patent No.: US 6,221,239 B1
(45) **Date of Patent: *Apr. 24, 2001**

(54) PROCESS FOR TRANSFORMING A GAS OIL CUT TO PRODUCE A DEAROMATISED AND DESULPHURISED FUEL WITH A HIGH CETANE NUMBER

(75) Inventors: Frédéric Morel, Francheville; Henri Delhomme, Sainte-Foy-les-Lyon; Nathalie George-Marchal, Paris, all of (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/480,628

(22) Filed: Jan. 10, 2000

Related U.S. Application Data

(63) Continuation of application No. 08/992,486, filed on Dec. 18, 1997, now Pat. No. 6,042,716.

(30) Foreign Application Priority Data

Dec. 20, 1996 (FR) ..... 96 15929

(51) Int. Cl.[7] ..... C10G 65/08; C10G 69/02

(52) U.S. Cl. ..... 208/89; 208/210; 208/143; 208/212; 585/264; 585/266; 585/269

(58) Field of Search ..... 208/89, 143, 210, 208/212; 585/264, 266, 269

(56) References Cited

U.S. PATENT DOCUMENTS

| | | | | |
|---|---|---|---|---|
| 3,236,764 | * | 2/1966 | Den Herder et al. | 208/210 |
| 3,356,608 | * | 12/1967 | Franklin | 208/212 |
| 3,899,543 | * | 8/1975 | Cosyns et al. | 208/89 |
| 4,225,461 | | 9/1980 | Cosyns et al. | 252/439 |
| 4,875,992 | | 10/1989 | Hammer | 208/89 |
| 5,110,444 | | 5/1992 | Haun et al. | 208/89 |
| 5,114,562 | * | 5/1992 | Haun et al. | 208/89 |
| 6,042,716 | * | 3/2000 | Morel et al. | 208/89 |

* cited by examiner

*Primary Examiner*—Walter D. Griffin
(74) *Attorney, Agent, or Firm*—Millen, White, Zelano & Branigan, P.C.

(57) ABSTRACT

A process for transforming a gas oil cut into a dearomatised fuel with a high cetane number comprises at least one first, deep desulphurisation and deep denitrogenation step in which the gas oil cut and hydrogen are passed over a catalyst comprising a mineral support, at least one group VIB metal or metal compound, at least one group VIII metal or metal compound, and phosphorous or at least one phosphorous compound, and at least one subsequent second step, dearomatisation, in which the desulphurised and denitrogenated product from the first step is passed with hydrogen over a catalyst comprising a mineral support and at least one group VIII noble metal or noble metal compound.

11 Claims, No Drawings

PROCESS FOR TRANSFORMING A GAS OIL CUT TO PRODUCE A DEAROMATISED AND DESULPHURISED FUEL WITH A HIGH CETANE NUMBER

This application is a continuation of application Ser. No. 8/992,486, filed Dec. 18, 1997 now U.S. Pat. No. 6,042,716.

FIELD OF THE INVENTION

The present invention relates to fuels for internal combustion engines. More particularly, it relates to the production of a fuel for compression ignition engines. Within this field, the invention relates to a process for transforming a gas oil cut to produce a dearomatised and desulphurised fuel with a high cetane number.

BACKGROUND OF THE INVENTION

Gas oil cuts, whether straight run from a crude petroleum or from a catalytic cracking process, currently still contain non negligible quantities of aromatic compounds, nitrogen-containing compounds and sulphur-containing compounds. The current legislation of the majority of industrialised countries dictates that engine fuel must contain less than 500 parts per million (ppm) of sulphur. Some countries have no current regulations which impose a maximum aromatics and nitrogen content. However, several countries or states, like Sweden and California, are known to be planning to limit the aromatics content to less than 20% by volume, or even to less than 10% by volume, and some experts believe that this limit could be 5% by volume. In Sweden in particular, certain classes of diesel fuel must already satisfy very severe specifications. Thus in that country, class II diesel fuel cannot contain more than 50 ppm of sulphur and more than 10% by volume of aromatic compounds, and that of class I cannot contain more than 10 ppm of sulphur and 5% by volume of aromatic compounds. Class III fuel in Sweden must currently contain less than 500 ppm of sulphur and less than 25% by volume of aromatic compounds. Similar limits also apply for the sale of that type of fuel in California.

During this time, motorists in several countries have pressed for legislation which will oblige gasoline producers to produce and sell a fuel with a minimum cetane number. Current French legislation requires a minimum cetane number of 49, but in the near future this minimum number could be at least 50 (as is already the case for class I fuel in Sweden), and probably at least 55; most probably it will be between 55 and 70.

A number of specialists are of the serious view that in the future the nitrogen content will be regulated, to less than 200 ppm, for example, or even less than 100 ppm. A low nitrogen content would improve the stability of the products, which would be welcomed by both the product vendor and the producer.

A reliable and efficient process thus needs to be developed, which process can produce a product with improved characteristics regarding the cetane number and the aromatics, sulphur and nitrogen content, from conventional straight run gas oil cuts or those from catalytic cracking (LCO cut) or from a different conversion process (coking, visbreaking, hydroconversion of residues, etc.). It is particularly important, and this is one of the advantages of the process of the present invention, to produce a minimum of gaseous hydrocarbon compounds and to be able to produce an effluent which is directly and integrally saleable as a very high quality fuel cut. Further, the process of the present invention can be conducted produced over a long period of time without the need for regeneration of the catalysts used, which have the advantage of being very stable over time.

SUMMARY OF THE INVENTION

In its broadest scope, the present invention thus concerns a process for transforming a gas oil cut to produce a dearomatised and desulphurised fuel with a high cetane number in at least two successive steps. It also concerns the fuel obtained by this process.

More precisely, the present invention concerns a process for transforming a gas oil cut into a dearomatised and desulphurised fuel with a high cetane number, comprising the following steps:

a) at least one first step for deep desulphurisation and deep denitrogenation in which the gas oil cut and hydrogen are passed over a catalyst comprising a mineral support, at least one metal or metal compound from group VIB of the periodic table in a quantity, expressed as the weight of metal with respect to the weight of finished catalyst, of about 0.5% to 40%, at least one metal or metal compound from group VIII of the periodic table in a quantity, expressed as the weight of metal with respect to the weight of finished catalyst, of about 0.1% to 30% and phosphorous or at least one phosphorous compound in a quantity, expressed as the weight of phosphorous pentoxide with respect to the weight of the support, of about 0.001% to 20%, and b) at least one subsequent second step for dearomatisation in which at least a portion, preferably all, of the product from the first step which has been at least partially and preferably completely desulphurised and denitrogenated is passed with hydrogen over a catalyst comprising, on a mineral support, at least one noble metal or noble metal compound from group VIII in a quantity, expressed as the weight of metal with respect to the weight of finished catalyst, of about 0.01% to 20%, and preferably at least one halogen.

Advantageously, in accordance with the process, hydrogen is introduced at each first and second step, and may be recycled to the first and second steps, independently of each other, meaning that the gases from the two steps are not handled together.

The effluent from the first step preferably undergoes steam stripping to separate at least part of the gas phase, which may be treated and optionally recycled at least in part to that step. At least a portion of the product from the stripping step undergoes the second step of the process of the invention.

The effluent from the final step is preferably steam stripped, is advantageously passes into a coalescer and is optionally dried.

In a preferred implementation of the invention, the operating conditions of steps a) and b) are selected as functions of the characteristics of the feed which may be a straight run gas oil cut, a gas oil from catalytic cracking or a gas oil from coking or visbreaking of residues, or a mixture of two or more of these cuts so as to obtain a product containing less than 100 ppm of sulphur and less than 200 ppm, preferably 50 ppm, of nitrogen and the conditions of step b) are selected so that the product obtained contains less than 10% by volume of aromatic compounds. These conditions may be rendered more severe so as to obtain, after the second step, a fuel containing less than 5% by volume of aromatic compounds, less than 50 ppm or even less than 10 ppm of sulphur, less than 20 ppm, or even less than 10 ppm of nitrogen, and with a cetane number of at least 50 or even at least 55, generally in the range 55 to 60.

To obtain such results, the conditions of step a) include a temperature of about 300° C. to about 450° C., a total pressure of about 2 MPa to about 20 MPa and an overall hourly space velocity of the liquid feed of about 0.1 to about 10, preferably 0.1 to 4, and those in step b) include a temperature of about 200° C. to about 400° C., a total pressure of about 2 MPa to about 20 MPa and an overall hourly space velocity of about 0.5 to about 10.

When a relatively low pressure range is desired while still producing excellent results, a first step al) can be carried out under conditions which can reduce the sulphur content of the product to about 500 to 800 ppm, then this product can be sent to a subsequent step a2) the conditions of which are selected to bring the sulphur content to a value which is below about 100 ppm, preferably below about 50 ppm, and the product from this step a2) is then sent to step b). In this implementation, the conditions of step a2) are identical or, as is preferable, milder than when a single step a) is used with a given feed, since the product sent to this step a2) already has a greatly reduced sulphur content. In this implementation, the catalyst in step al) can be a conventional prior art catalyst such as that described in the text of our French patent applications FR-A-2 197 966 and FR-A-2 538 813 and that of step a2) is that described above for step a). The scope of the invention includes using the same catalyst in steps a1) and a2).

In these steps a), a1) and a2), the catalyst support can be selected from the group formed by alumina, silica, silica-aluminas, zeolites, titanium oxide, magnesia, zirconia, clays and mixtures of at least two of these mineral compounds. Alumina is most frequently used.

In a preferred implementation of the invention, the catalyst in these steps a), a1), a2) will comprise, deposited on the support, at least one metal or metal compound, advantageously selected from the group formed by molybdenum and tungsten and at least one metal or metal compound advantageously selected from the group formed by nickel, cobalt and iron. The catalyst most frequently comprises molybdenum or a molybdenum compound and at least one metal or metal compound selected from the group formed by nickel and cobalt.

In a particular and preferred implementation of the invention, the catalyst in steps a), a1) and a2) comprises boron or at least one boron compound, preferably in a quantity of 10% or less, expressed as the weight of boron trioxide with respect to the weight of the support, preferably deposited on the support.

The quantity of group VIB metal or metal compound (preferably Mo), expressed as the weight of metal with respect to the weight of finished catalyst, is preferably about 2% to 30%, more preferably about 5% to 25%, and that of the group VIII metal or metal compound (preferably Ni or Co) is preferably about 0.5% to 15%, more preferably about 1% to 10%.

A catalyst containing Ni, Mo, and P is preferably used, the proportions of these elements having been defined above, or more preferably Ni, Mo, P and B.

A particularly advantageous catalyst is that described in European patent EP-A-0 297 949, the disclosure of which is hereby incorporated.

This catalyst comprises: a) a support comprising a porous mineral matrix, boron or a boron compound and phosphorous or a phosphorous compound, and b) at least one metal or metal compound from group VIB of the periodic table and at least one metal or metal compound from group VIII of the periodic table, in which the sum of the quantities of boron and phosphorous, respectively expressed as the weight of boron trioxide ($B_2O_3$) and phosphorous pentoxide ($P_2O_5$) with respect to the weight of the support, is about 5% to 15%, preferably about 8% to 12% and advantageously about 8% to 11.5%, the atomic ratio of boron to phosphorous (B/P) being about 1.05:1 to 2:1, preferably about 1.1:1 to 1.8:1. Advantageously, at least 40% and preferably at least 50% of the total pore volume of the finished catalyst is contained in pores with an average diameter of more than 13 nanometers.

The catalyst preferably has a total pore volume in the range 0.38 to 0.51 $cm_3\ xg^{-1}$.

The quantity of group VIB metals or metal compounds contained in the catalyst is normally such that the atomic ratio of phosphorous to the group VIB metal or metals (P/VIB) is about 0.5:1 to 1.5:1, preferably about 0.7:1 to 0.9:1.

The respective quantities of group VIB metal or metals and group VIII metal or metals contained in the catalyst are normally such that the atomic ratio of group VIII metal or metals to group VIB metal or metals (VIII/VIB) is about 0.3:1 to 0.7: 1, preferably about 0.3:1 to about 0.45:1.

The quantity by weight of the metals contained in the finished catalyst, expressed as the weight of metal with respect to the weight of the finished catalyst, is normally about 2% to 30%, preferably about 5% to 25%, for the group VIB metal or metals, and about 0.1% to about 15%, more particularly about 0.1% to 5%, for the group VIII metal or metals, and preferably about 0.15% to 3% in the case of noble group VIII metals (Pt, Pd, Ru, Rh, Os, Ir) and about 0.5% to 15%, preferably about 1% to 10%, in the case of non noble group VIII metals (Fe, Co, Ni).

In step b), the mineral support can be selected from the group formed by alumina, silica, silica-aluminas, zeolites, titanium oxide, magnesia, boron oxide, zirconia, clays and mixtures of at least two of these mineral compounds. The support preferably comprises at least one halogen selected from the group formed by chlorine, fluorine, iodine and bromine, preferably chlorine and fluorine. In an advantageous embodiment, the support comprises chlorine and fluorine. The quantity of halogen is normally about 0.5% to about 15% by weight with respect to the weight of the support. The support is normally alumina. The halogen is normally introduced into the support by the corresponding acid halide and the noble metal, preferably platinum or palladium is introduced, for example, from aqueous solutions of their salts or compounds such as hexachloroplatinic acid in the case of platinum.

The quantity of noble metal (preferably Pt or Pd) in the catalyst in step b) is preferably about 0.01% to 10%, usually about 0.01% to 5%, and generally about 0.03% to 3%, expressed as the weight of metal with respect to the weight of finished catalyst.

A particularly advantageous catalyst is described in FR-A-2 240 905, the disclosure of which is hereby incorporated. It comprises a noble metal, alumina, and a halogen, and is prepared by mixing the aluminous support with a noble metal compound and a reducing agent with formula $AlX_yR_{3-y}$ where y is 1, ⅔ or 2, X is a halogen and R is a monovalent hydrocarbon radical.

A further highly suitable catalyst is that described in U.S. Pat. No. 4,225,461. It comprises a noble metal and a halogen and is prepared in a particular manner.

The following examples illustrate the invention without limiting its scope.

EXAMPLE 1

A straight run gas oil cut was used. Its characteristics are shown in Table 1. Its sulphur content was 1.44%.

This gas oil cut was treated in a two-step sequence:

A first step with a catalyst containing, in the form of the oxide, about 3% of nickel, 16.5% of molybdenum and 6% of $P_2O_5$ on alumina. This first step was for deep desulphurisation and deep denitrogenation of the gas oil cut.

A second step with a catalyst containing about 0.6% of platinum on alumina.

This second step was essentially for deep dearomatisation of the effluent from the first step, but also to further reduce the sulphur content.

The first step was carried out in a hydrotreatment pilot unit. This comprised two reactors in series which could contain up to 20 l of catalyst in a fixed bed. The unit comprised a compressor for recycling hydrogen. The fluids were in downflow mode in each reactor. The unit was provided with an in-line steam stripping column for stripping the effluent from the reaction which was thereby completely freed of the $H_2S$ and $NH_3$ formed during the reaction. 5 l of the same catalyst was charged into each reactor of the pilot reactor.

Deep desulphurisation and deep denitrogenation of the gas oil cut was carried out in this unit under the following operating conditions:

HSV=1.5 $h^{-1}$;

Total pressure=50 bar (10 bar=1 MPa);

$H_2$ recycle=400 normal litres $H_2$/litre of feed (Nl/l);

Temperature=340° C.

A product was obtained which had been deeply desulphurised (sulphur content below 50 ppm) and very deeply denitrogenated (nitrogen content below 6 ppm).

These characteristics are shown in Table 1. The material balance is shown in Table 2.

The effluent was retained for pilot tests of the second step.

The second step was carried out in a smaller pilot unit comprising a 1 l reactor with fluid upflow. The unit did not comprise a recycling compressor.

1 l of catalyst was charged into this unit in a fixed bed.

The operating conditions were as follows:

HSV=6 $h^{-1}$;

Total pressure=50 bar;

$H_2$ recycle=400 Nl $H_2$/litre of feed;

Temperature=300° C.

A product was obtained which had been very deeply dearomatised (aromatics content below 5%) which had a very high cetane number (65).

These characteristics are shown in Table 1.

The material balance is shown in Table 2. No gas formation was detected during the operation. The whole of the effluent could be sold as a very high quality fuel cut.

TABLE N°1

Feed and effluent analysis, 1st and 2nd step

| Properties | Feed SR gas oil | 1st step | 2nd step |
|---|---|---|---|
| 15/4 density | 0.852 | 0.830 | 0.824 |
| Refractive index | 1.4748 | 1.4600 | 1.454 |
| Pour point ° C. | −3 | −3 | −6 |
| Aniline point ° C. | 71.7 | 79.1 | 86.7 |
| Sulphur, ppm | 14400 | 30 | 4 |
| Nitrogen, ppm | 110 | 6 | 6 |
| Aromatics, ppm | 30 | 22 | 2 |
| Motor cetane number | 56 | 61 | 65 |

TABLE N°1-continued

Feed and effluent analysis, 1st and 2nd step

| Properties | Feed SR gas oil | 1st step | 2nd step |
|---|---|---|---|
| D86: IP, ° C. | 223 | 205 | 205 |
| D86: 95% v, ° C. | 375 | 365 | 359 |

(D86 indicates the ASTM-D86 method).

TABLE N°2

Material balance 1st and 2nd step

| Wt %/feed | 1st step | 2nd step |
|---|---|---|
| $H_2S$ | 1.53 | 0.01 |
| $NH_3$ | 0.01 | 0.00 |
| C1 | 0.01 | 0.00 |
| C2 | 0.01 | 0.00 |
| C3 | 0.02 | 0.00 |
| C4 | 0.02 | 0.00 |
| C5+ | 99.14 | 100.49 |
| Total | 100.74 | 100.50 |

EXAMPLE 2

A catalytically cracked gas oil cut (LCO) was used. Its characteristics are shown in Table 3. Its sulphur content was 1.56%.

This gas oil cut was treated in a two-step sequence:

A first step with a catalyst containing, in the form of the oxide, about 3% of nickel, 16.5% of molybdenum and 6% of $P_2O_5$ on alumina. This first step was for deep desulphurisation and deep denitrogenation of the gas oil cut.

A second step with a catalyst containing about 0.6% of platinum on alumina.

This second step was essentially for deep dearomatisation of the effluent from the first step, but also to further reduce the sulphur and nitrogen content.

The first step was carried out in a hydrotreatment pilot unit. This comprised two reactors in series which could contain up to 20 l of catalyst. The unit comprised a compressor for recycling hydrogen. The fluids were in downflow mode in each reactor. The unit was provided with an in-line steam stripping column for stripping the effluent from the reaction which was thereby completely freed of the $H_2S$ and $NH_3$ formed during the reaction. 5 l of the same catalyst was charged into each reactor of the pilot reactor.

Deep desulphurisation and deep denitrogenation of the gas oil cut was carried out in this unit under the following operating conditions:

HSV=1 $h^{-1}$;

Total pressure=80 bar (10 bar=1 MPa);

$H_2$ recycle=400 Nl $H_2$/litre of feed;

Temperature=375° C.

A product was obtained which had been deeply desulphurised (sulphur content below 50 ppm) and very deeply denitrogenated (nitrogen content below 6 ppm).

These characteristics are shown in Table 3. The material balance is shown in Table 4.

The effluent was retained for pilot tests of the second step.

The second step was carried out in a smaller pilot unit comprising a 1 l reactor with fluid upflow. The unit did not comprise a recycling compressor.

1 l of catalyst was charged into this unit in a fixed bed.

The operating conditions were as follows:

HSV=4 $h^{-1}$;

Total pressure=50 bar;

$H_2$ recycle=400 l $H_2$/l of feed;

Temperature=300° C.

A product was obtained which had been very deeply dearomatised (aromatics content below 5%) which had a cetane number of 54.

These characteristics are shown in Table 3.

The material balance is shown in Table 4. No gas formation was detected during the operation. The whole of the effluent could be upgraded as a very high quality fuel cut.

TABLE N°3

Feed and effluent analysis, 1st and 2nd step

| Properties | Feed LCO | 1st step | 2nd step |
|---|---|---|---|
| 15/4 density | 0.942 | 0.873 | 0.857 |
| Refractive index | 1.5417 | 1.4818 | 1.4676 |
| Pour point ° C. | 3 | 3 | 3 |
| Aniline point ° C. | 37 | 62 | 76 |
| Sulphur, ppm | 15600 | 30 | 5 |
| Nitrogen, ppm | 1089 | 16 | 8 |
| Aromatics, ppm | 72 | 32 | 4 |
| Motor cetane number | 27 | 45 | 54 |
| D86: IP, ° C. | 184 | 147 | 174 |
| D86: 95% v, ° C. | 394 | 382 | 380 |

TABLE N°4

Material balance 1st step and 2nd step

| Wt %/feed | 1st step | 2nd step |
|---|---|---|
| $H_2S$ | 1.66 | 0.00 |
| $NH_3$ | 0.13 | 0.00 |
| C1 | 0.08 | 0.00 |
| C2 | 0.08 | 0.00 |
| C3 | 0.06 | 0.00 |
| C4 | 0.05 | 0.00 |
| C5+ | 100.36 | 100.92 |
| Total | 102.42 | 100.93 |

EXAMPLE 3

The same feed as that treated in Example 2 was used, under the same HSV, total pressure, $H_2$ recycle and temperature conditions in each of the steps, the only difference being that in the first step a catalyst containing, in its oxide form, about 3% of nickel, 15% of molybdenum, 5% of $P_2O_5$ and 3.5% of $B_2O_3$ on alumina was used, and in the second step a catalyst containing about 0.6% of platinum, 1% of chlorine and 1% of fluorine on alumina was used. The material balance in each of the steps was the same as that given in Example 2, Table 4. An analysis of the effluent from the 1st and 2nd steps is shown in the Table below.

| Properties | Feed LCO | 1st step | 2nd step |
|---|---|---|---|
| 15/4 density | 0.942 | 0.873 | 0.856 |
| Refractive index | 1.5417 | 1.4818 | 1.4666 |

-continued

| Properties | Feed LCO | 1st step | 2nd step |
|---|---|---|---|
| Pour point ° C. | 3 | 3 | 3 |
| Aniline point ° C. | 37 | 62 | 77 |
| Sulphur, ppm | 15600 | 21 | 4 |
| Nitrogen, ppm | 1089 | 8 | 4 |
| Aromatics, ppm | 72 | 32 | 3 |
| Motor cetane number | 27 | 45 | 55 |
| D86: IP, ° C. | 184 | 147 | 174 |
| D86: 95% v, ° C. | 394 | 382 | 380 |

This example shows the effect of using a catalyst containing boron in the 1st step and also shows the influence of using a catalyst containing both chlorine and fluorine in the 2nd step.

What is claimed is:

1. A process for transforming a gas oil cut into a diesel fuel having a cetane number of at least 49, less than 100 ppm of sulphur, less than 200 ppm of nitrogen and less than 10% by volume of aromatic compounds, comprising the following steps:

a) passing the gas oil cut and hydrogen under denitrogenation and desulphurisation conditions in at least one step over a catalyst comprising a mineral support, at least one metal or metal compound from group VIB of the periodic table in a quantity, expressed as the weight of metal with respect to the weight of finished catalyst, of about 0.5% to 40%, at least one metal or metal compound from group VIII of the periodic table in a quantity, expressed as the weight of metal with respect to the weight of finished catalyst, of about 0.1% to 30%, and phosphorous or at least one phosphorous compound in a quantity, expressed as the weight of phosphorous pentoxide with respect to the weight of the support, of about 0.001% to 20% to produce an at least partially denitrogenated and desulfurised effluent;

(b) steam stripping the effluent from step (a) and, optionally, recycling hydrogen therein for use in step (a);

(c) passing at least a portion of the steam stripped effluent from step (b) with hydrogen under dearomatisation conditions over a catalyst comprising, on a mineral support, at least one noble metal or noble metal compound from group VIII in a quantity, expressed as the weight of metal with respect to the weight of finished catalyst, of about 0.01% to 20% to produce a denitrogenated, desulfurised and dearomatised diesel fuel, and, optionally, recycling hydrogenation for use in step (c);

with the further provision that fresh hydrogen is introduced into steps (a) and (c) independently of each other and that recycle hydrogen from step (b) is recycled to only step(a) and recycle hydrogen from step (c) is recycled to only step (c).

2. A process according to claim 1, in which the operating conditions of step a) include a temperature of about 300° C. to about 450° C., a total pressure of about 2 MPa to about 20 MPa and an overall hourly space velocity of the liquid feed of about 0.1 to about 10 $h^{-1}$, and those in step d) include a temperature of about 200° C. to about 400° C., a total pressure of about 2 MPa to about 20 MPa and an overall hourly space velocity of about 0.5 to about 10 $h^{-1}$.

3. A process according to claim 1, in which the catalyst in step a) comprises at least one metal or metal compound selected from the group consisting of molybdenum and tungsten and at least one metal or metal compound selected from the group consisting of nickel, cobalt and iron.

4. A process according to claim 1, in which the catalyst in step a) comprises molybdenum or a molybdenum compound in a quantity, expressed as the weight of metal with respect to the weight of finished catalyst, of about 2% to 30% and a metal or metal compound selected from the group consisting of nickel and cobalt in a quantity, expressed as the weight of metal with respect to the weight of finished catalyst, of about 0.5% to 15%.

5. A process according to claim 1, wherein in step a) the VIII metal is nickel and the group VIB metal is molybdenum.

6. A process according to claim 1, in which the catalyst of step a) further comprises boron or at least one boron compound in a quantity of 10% or less, expressed as the weight of boron trioxide with respect to the weight of the support.

7. A process according to claim 1, in which the support for the catalysts used in step a) and in step c) is selected independently of each other from the group consisting of alumina, silica, silica-aluminas, zeolites, titanium oxide, magnesia, boron oxide, zirconia, clays and mixtures of at least two of these mineral compounds.

8. A process according to claim 1, in which the catalyst of step c) comprises at least one metal or metal compound selected from the group consisting of palladium and platinum in a quantity, expressed as the weight of metal with respect to the weight of finished catalyst, of about 0.01% to 10%.

9. A process according to claim 1, wherein the steam stripped effluent passed into step c) has a sulfur content of less than 100 ppm.

10. A process according to claim 1, wherein the steam stripped effluent passed into step c) has a sulfur content of less than 50 ppm.

11. A process according to claim 1, wherein step b) is the sole stripping step.

* * * * *

Disclaimer 6,221,239—Frederic Morel, Francheville; Henri Delhomme, Sainte-Foy- les-Lyon; Nathalie George-Marchal, Paris, all of France. PROCESS FOR TRANSFORMINNG A GAS OIL CUT TO PRODUCE A DEAROMATISED AND DESULPHURISED FUEL WITH A HIGH CETANCE NUMBER. Patent dated April 24, 2001. Disclaimer filed Oct. 30, 2000, by the Assignee Institut Francais du Petrole, Rueil Malmasion.

The term of this patent which extend beyond the expiration date of Pat. No. 6,042,716.

*(Official Gazette March 18, 2008)*